US006745711B1

(12) United States Patent
Martelli

(10) Patent No.: US 6,745,711 B1
(45) Date of Patent: Jun. 8, 2004

(54) SEWING MACHINE PRESSURE FOOT AND BIAS BINDER PLATE ASSEMBLY

(76) Inventor: John D. Martelli, 321 S. 61st Ave., Pensacola, FL (US) 32506

( * ) Notice: Subject to any disclaimer, the term of this patent is extended or adjusted under 35 U.S.C. 154(b) by 0 days.

(21) Appl. No.: 10/340,077

(22) Filed: Jan. 13, 2003

Related U.S. Application Data

(63) Continuation-in-part of application No. 09/963,323, filed on Sep. 27, 2001, now abandoned, and a continuation-in-part of application No. 10/254,718, filed on Sep. 26, 2002.

(51) Int. Cl.[7] ..... D05B 29/12
(52) U.S. Cl. ..... 112/151; 112/235
(58) Field of Search ..... 112/235, 151, 112/150, 152, 136, 137, 141, 147, 153

(56) References Cited

U.S. PATENT DOCUMENTS 1,760,500 A * 5/1930 Ives ..... 112/141
1,855,139 A * 4/1932 Sailer ..... 112/136
2,282,042 A * 5/1942 Enos ..... 112/141
2,296,509 A * 9/1942 Enos ..... 112/141
2,478,032 A * 8/1949 Wallsh ..... 112/151
3,146,743 A * 9/1964 Minehan ..... 112/151
4,494,471 A * 1/1985 Zylbert ..... 112/235

* cited by examiner

*Primary Examiner*—Ismael Izaguirre
(74) *Attorney, Agent, or Firm*—George A. Bode; Lisa D. Velez; Bode & Associates

(57) ABSTRACT

A pressure foot for minimizing puckering or bunching of biasing fabric and a cloth item, garment or quilt when being sewn or finished. The pressure foot includes a laterally displaced inner foot displaced from the inner feed dog of the sewing machine and a bias guide between the inner and outer feet. The pressure foot is adapted to be used alone or in combination with a bias binder sewing aid that automatically folds the biasing fabric. The pressure foot and bias binder sewing aid form a kit for sewing biasing fabric to an unfinished edge of a cloth item, garment, quilt or the like.

14 Claims, 4 Drawing Sheets

SEWING MACHINE PRESSURE FOOT AND BIAS BINDER PLATE ASSEMBLY

CROSS-REFERENCE TO RELATED APPLICATIONS

This application is a continuation-in-part of previous pending applications by the same inventor bearing U.S. Ser. No. 09/963,323, filed Sep. 27, 2001, and now abandoned; and, Ser. No. 10/254,718, filed Sep. 26, 2002. Applicant claims the benefit, under 35 U.S. Code, Section 120, of the following U.S. applications: Ser. No. 09/963,323, filed Sep. 27, 2001; and, Ser. No. 10/254,718, filed Sep. 26, 2002. The entirety of each of these previous applications is incorporated herein by reference as if set forth in full below.

BACKGROUND OF THE INVENTION

1. Field of the Invention

The present invention relates to sewing machine pressure foot devices and, more particularly, to a pressure foot adapted to be attached to a conventional sewing machine or a bias binder sewing aid, the pressure foot being constructed to minimize, if not eliminate, puckering or bunching of fabric during sewing.

2. General Background

A conventional pressure foot includes a base mountable to a conventional sewing machine, a pair of spaced-apart parallel "skis" to keep constant downward pressure on the cloth item from above so that the cloth item can be pulled evenly through the skis by two motorized feed teeth or feed wheels (hereinafter referred to as "feed dogs").

In operation, the needle moves up and down between the skis and the feed dogs. However, in sewing quilt designs or when finishing with biasing fabric, the sewn item is often bulky and does not move evenly causing puckering and bunching thereof. The puckering and bunching is most problematic when sewing corners and curved lines such as, without limitation around corners.

Several devices have been patented which attempt to aid in the sewing of contoured lines or eliminate puckering.

U.S. Pat. No. 3,871,306, entitled "FEED CONTROL," U.S. Pat. No. 3,965,832, entitled "METHOD OF CONTOUR SEWING" and U.S. Pat. No. 4,024,825, entitled "SEWING MACHINE WORK SUPPORT AND FEED CONTROL," all related and issued to Wolverine World Wide, Inc., of Rockford, Michigan, on the applications of R. B. Egtvedt, et al., disclose, an apparatus for use on a conventional sewing machine that employs a walking pressure foot and non-walking pressure foot that allow contour sewing.

U.S. Pat. No. 5,335,612 issued to Pathold Investments Company Limited, on the application of J. Cizek, et al., entitled "ANTI-PUCKER PRESSURE FOOT," discloses, an anti-pucker pressure foot for a sewing machine comprising: a reciprocating lower feed-dog which engages the lower layer of the material and a first upper pressure foot which overlies the feed-dog and urges the upper layer and lower layer of material towards the feed-dog. A retarding surface upon which the lower layer is urged by a second pressure foot to equalize tension upstream between layers.

U.S. Pat. No. 5,370,072 issued to Union Special Corporation, of Huntley, Illinois, on the application of M. Adamski, Jr., entitled "AUTOMATIC ALIGNMENT OF MATERIAL AND POSITIONING AT THE STITCH FORMING LOCATION," discloses a dual-wheel alignment device for a sewing machine that positions the material at the stitch forming location.

Other patents related to pressure foots include: U.S. Pat. No. 4,359,955, entitled "DETACHABLE PRESSURE FOOT"; U.S. Pat. No. 4,069,780, entitled "SEWING MACHINE WITH MEANS FOR STITCHING SLIDE FASTENER STRINGERS ONTO A RELATIVELY THICK ARTICLE"; and, U.S. Pat. No. 6,332,414, entitled "SEWING MACHINE ACCESSORY," all of which disclose various pressure foot designs.

As can be readily seen, there is a continuing need for a pressure foot design for use in sewing biasing fabric to garments or quilts that minimizes puckering or bunching.

As will be seen more fully below, the present invention is substantially different in structure, methodology and approach from that of prior pressure foot devices and bias binder sewing kits.

SUMMARY OF THE PRESENT INVENTION

The preferred embodiment of the pressure foot and bias binder sewing aid kit of the present invention solves the aforementioned problems in a straight forward and simple manner.

Broadly, the present invention contemplates a pressure foot for use with a conventional sewing machine comprising: a base adapted to be mounted to a mount of the sewing machine; parallel inner and outer feet, the outer foot being substantially aligned with an outer feed dog of the machine and an inner foot laterally displaced from the outer foot and the inner feed dog of said machine; and, a bias guide formed between the inner and outer feet having a channel formed between interior walls of the outer foot and the inner foot and a joining top surface joining the inner and outer feet for feeding biasing fabric therethrough during sewing.

The present invention further contemplates a kit that includes a pressure foot with a bias guide and a bias binder sewing aid which folds the biasing fabric into quarters and feeds the folded biasing fabric into the bias guide of the pressure foot.

In view of the above, an object of the present invention is to provide a pressure foot that minimized, if not eliminates, puckering or bunching when sewing biasing fabric to quilts, garments or the like.

Another object of the present invention is to provide a pressure foot that includes a bias guide that laterally limits the movement of the biasing fabric in the direction of the inner foot.

A further object of the present invention is to provide a pressure foot that includes a bias guide that serves as a seam width measuring tool.

In view of the above, a feature of the present invention is to provide a pressure foot and/or kit that is simple to use.

The above and other objects and features of the present invention will become apparent from the drawings, the description given herein, and the appended claims.

BRIEF DESCRIPTION OF THE DRAWING

For a further understanding of the nature and objects of the present invention, reference should be had to the following description taken in conjunction with the accompanying drawings in which like parts are given like reference numerals and, wherein.

DETAILED DESCRIPTION OF THE PREFERRED EMBODIMENT

Figure 1:
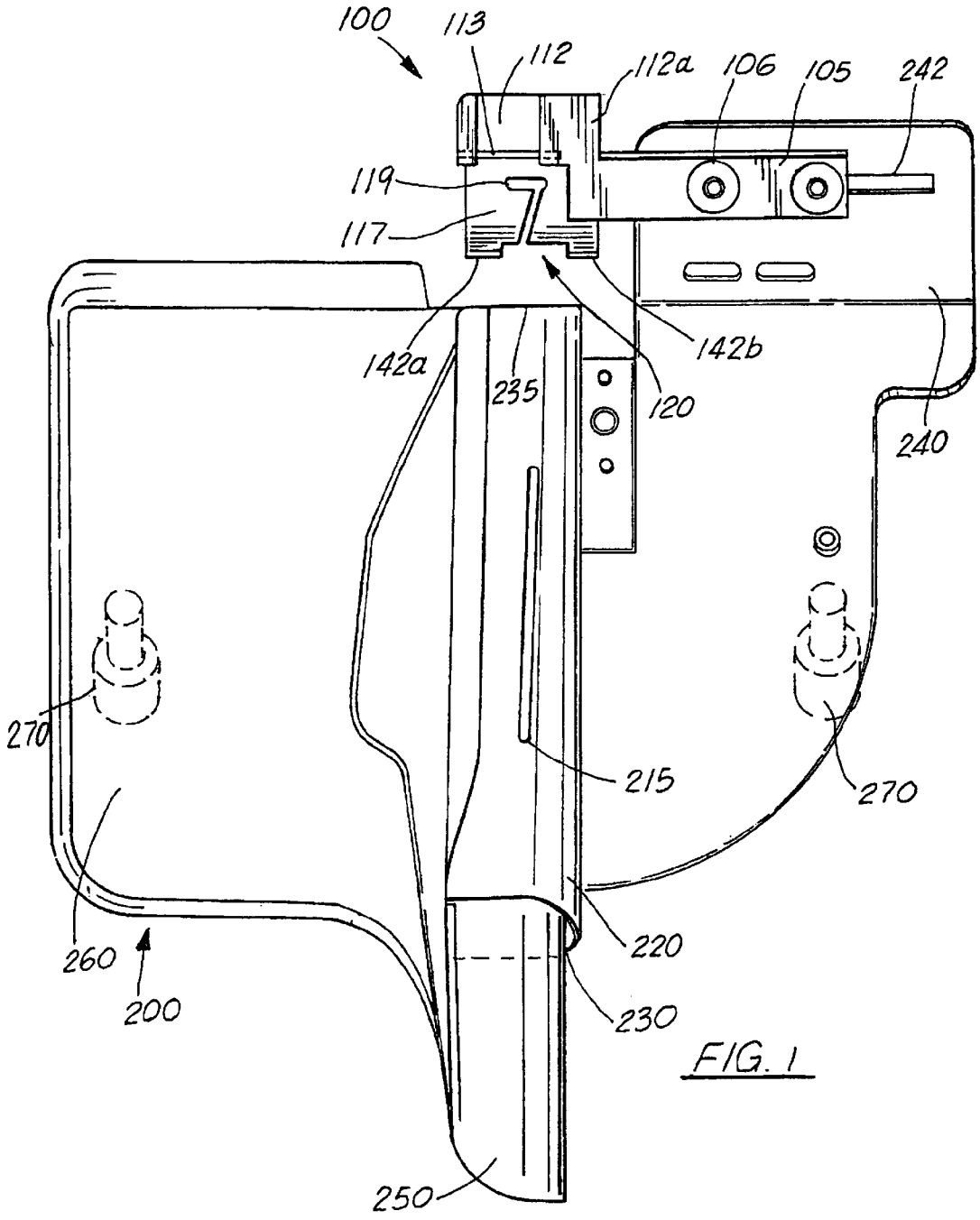
FIG. 1 illustrates a top perspective view of the pressure foot and bias binder sewing aid kit of the present invention.

Referring now to the drawings and in particular FIGS. 1–5, the pressure foot of the present invention is generally referenced by the numeral 100. The pressure foot 100 is comprised of a base 112 mountable to a conventional sewing machine via the machine's foot lifting arm (NOT SHOWN). The base 112 is mounted by pin 113 through mounting apertures in the base 112. Accordingly, in operation, the machine's foot lifting arm (NOT SHOWN) can lift the pressure foot 100, if needed, in a conventional manner in order to lift or remove the applied pressure from biasing fabric 5.

Alternately, the pressure foot 100 can be attached to a bise binder sewing aid 200. Integrated with the base 112 is a pair of spaced-apart parallel feet 116*a*, 116*b* and an attachment arm 105 for attachment to the bias binder sewing aid 200, such as described in U.S. patent application having Ser. No. 09/963,323, filed Sep. 27, 2001, for "BIAS BINDER SEWING AID ASSEMBLY WITH A BIASING FABRIC DISPENSER," incorporated herein by reference as if set forth in full below. Nevertheless, other bias binder sewing aids can be used such as disclosed in U.S. patent application Ser. No. 08/950,831, entitled "BIAS BINDER FOR A SEWING MACHINE", filed Oct. 15, 1997; and U.S. Pat. No. 5,906,159, entitled "BIAS BINDER SEWING AID FOR SEWING MACHINES," issued May 25, 1999 both of which are incorporated herein by reference as if set forth in full below.

Figure 2:
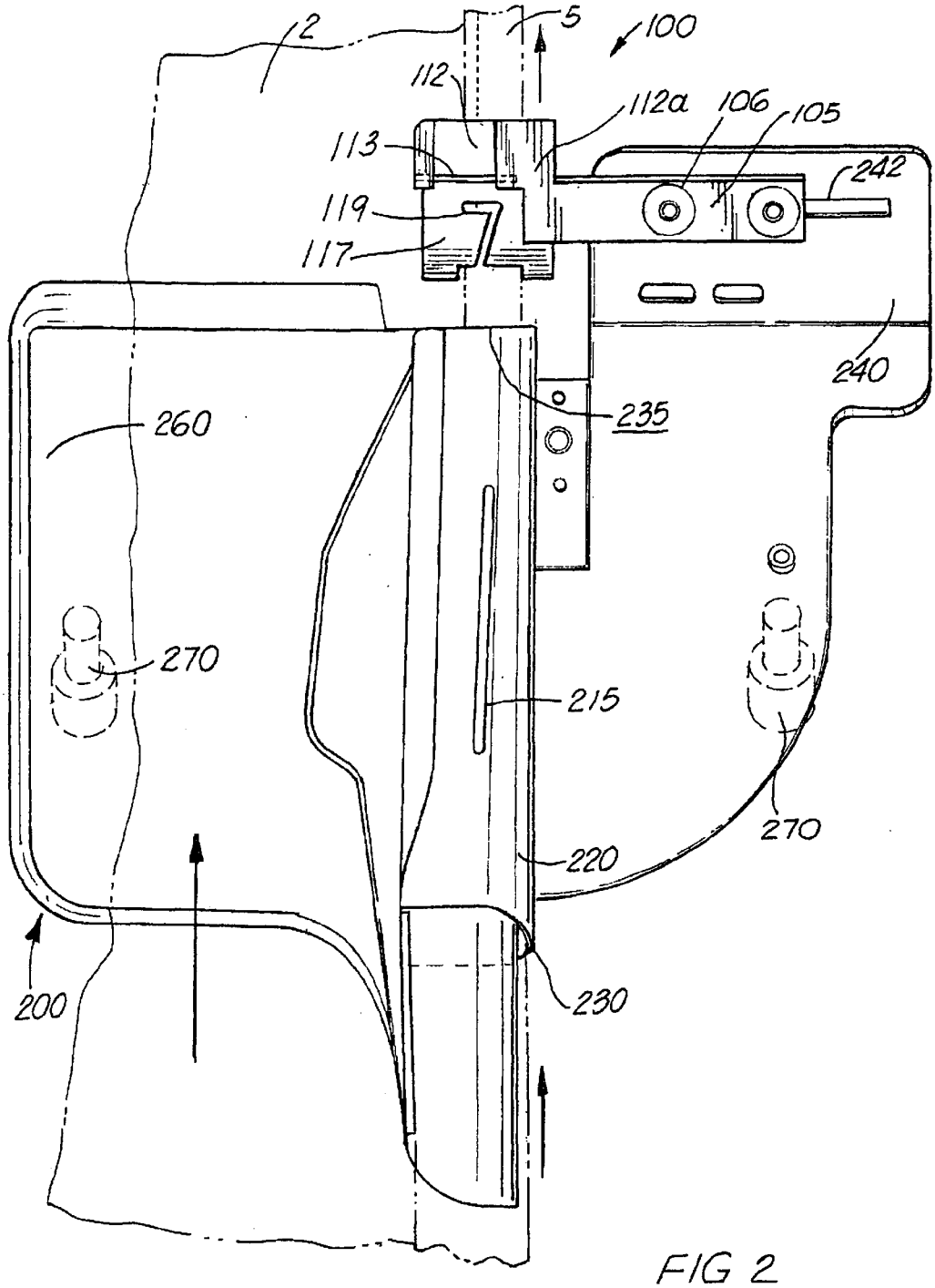
FIG. 2 illustrates a top perspective view of the pressure foot and bias binder sewing aid kit of the embodiment of FIG. 1 with biasing fabric being sewn to a cloth item.

In general the bias binder sewing aid 200 automatically folds biasing fabric 5 evenly into quarters and aids in the feeding of the folded biasing fabric 5 for attachment to an unfinished edge of a cloth item, garment, quilt 2, or the like, as best seen in FIG. 2.

Conventionally, pressure feet keep constant downward pressure on the cloth item from above so that the cloth item can be pulled evenly under the feet by feed dogs (NOT SHOWN). The feed dogs 8 (FIG. 3) are underneath the lower cloth item and mate and engage with the feet through the upper and lower cloth items, as the needle 7 moves up and down between feet and the feed dogs. Furthermore, the conventional feet design are called "skis" because of their front-end contour. Alternately, the pressure foot itself sometimes is referred to as a sleigh.

In the exemplary embodiment, the bottom of the outer foot 116*a* and inner foot 116*b* have, in general, the traditional "ski" contour. For example, the upward curving contour at the front ends 142*a* and 142*b* of the outer foot 116*a* and the inner foot 116*b* can be seen in FIG. 3. Accordingly, the outer foot 116*a* and the inner foot 116*b* will sometimes be referred to as the "outer ski" and the "inner ski," respectively.

However, pressure foot 100 differs from the conventional ski design in that the outer foot 116*a* and the inner foot 116*b* do not have independent or separated top surfaces. Instead, a single top surface 117 joins the outer foot 116*a* and the inner foot 116*b*. The top surface 117 is essentially horizontal and its forward end is upwardly curved similar to the forward curvature of the outer foot 116*a* and the inner foot 116*b* defining the ski contour. The joining top surface 117 has formed therein a needle and thread slot 119 for receipt of the machine's needle 7 when sewing.

The inner foot 116*b* is laterally displaced away from its formerly underlying feed dog in order to accommodate for a bias guide 120 between the two parallel feet 116*a* and 116*b*. Furthermore, the inner foot 116*b* is slightly narrower in width as compared to outer foot 116*a*.

Because the inner foot 116*b* is laterally displaced, base 112 is laterally extended by extension section 112*a*, having a width of such lateral displacement. Furthermore, the needle and thread slot 119 is in closer proximity to the outer foot 116*a* as compared to the displayed inner foot 116*b* as the result of such lateral displacement.

In the exemplary embodiment, the needle and thread 119 resembles a "7"-shaped channel formed in the joining top surface 117. Nevertheless other configurations may be used such as a simple hole.

Figure 5:
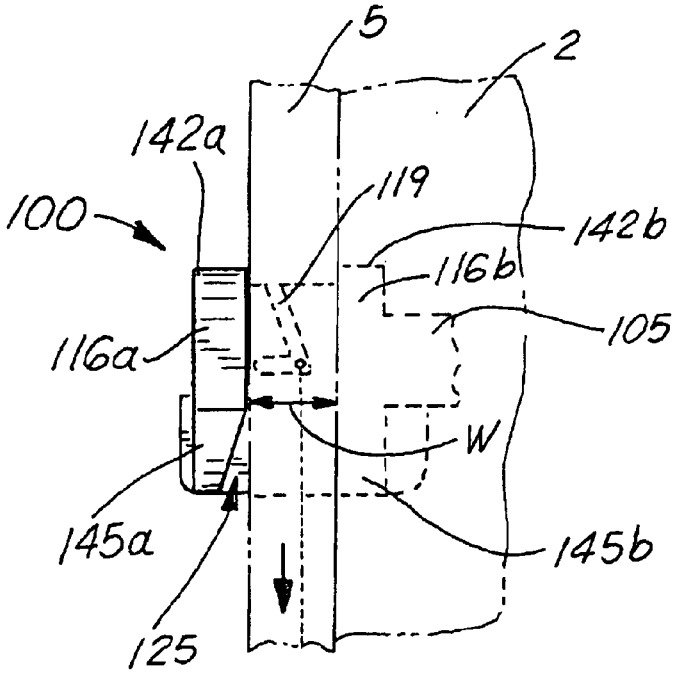

The bias guide 120 has a channel 125 adapted to receive fabric 5 therein, as best seen in FIG. 5. The channel 125 feeds therethrough the folded fabric 5 between the outer foot 116*a* and the inner foot 116*b*. Additionally, the channel 125 provides a seam measuring tool so that seams can be straight or of the same width.

The channel 125 is defined between the interior walls of the outer foot 116*a* and the inner foot 116*b* and the joining top surface 117. The joining top surface 117 provides some downward pressure on the layers defined by the folded biasing fabric 5 and the cloth item 2 which is the thickest part. Outer foot 116*a* provides pressure to the cloth item 2 directly under the outer foot 116*a*.

The plate in the machine through which the feed dogs 8 project typically includes lines to the right of the outer ski of a convention pressure foot for establishing the seam width. However, when sewing, the seamstress must constantly pull, tub and readjust the fabric so that the seam width remains the same even around corners. This process is cumbersome and oftentimes creates uneven seamlines despite the efforts by the seamstress to maintain an even seam because the fabric tends to creep away from the measuring lines since there is nothing to limit or inhibit fabric movement.

The bias guide 120 of the present invention not only allows from establishing a seam width, but also provides a lateral fabric limiting tool or means which will be made clear from the description immediately below.

Figure 4:
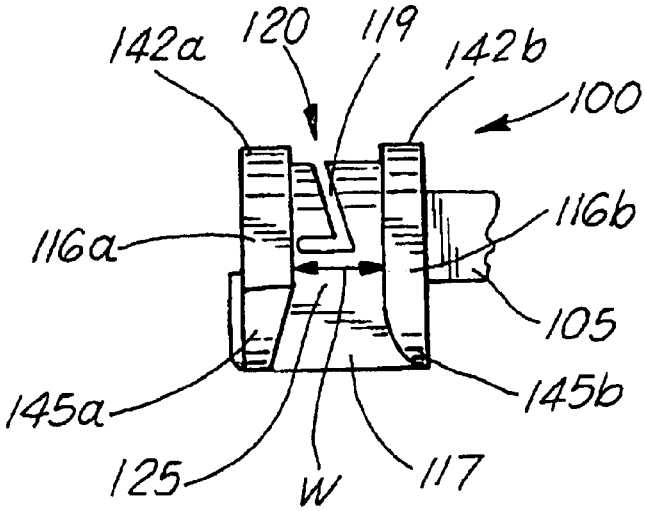
FIG. 4 illustrates a partial bottom view of the pressure foot of the embodiment of FIG. 1; and, FIG. 5 illustrates the partial bottom view of the pressure foot of the embodiment of FIG. 4 with biasing fabric being feed therethrough.

Referring still to FIGS. 4 and 5, the width of the rear end of the channel 125 flares to form a flared outlet. The flared outlet allows for enhanced control when sewing the fabric 5 to a cloth item, quilt or the like. More specifically, when turning the biasing fabric 5 or the sewn fabric 5 and cloth item 2, the flared outlet of minimizes bunching, puckering or gapping.

As previously described the outer foot 116*a* and the inner foot 116*b* includes forwardly curved front ends 142*a* and 142*b*. However, the rear end 145*a* of the interior wall of the outer foot 116*a* gradually tapers along a generally straight line. Moreover, the bottom surface of the tapered rear end 145*a* has been trimmed or beveled. On the other hand, rear end 145*b* of the interior wall of the inner foot 116*b* gradually tapers along a generally curved line.

Figure 3:
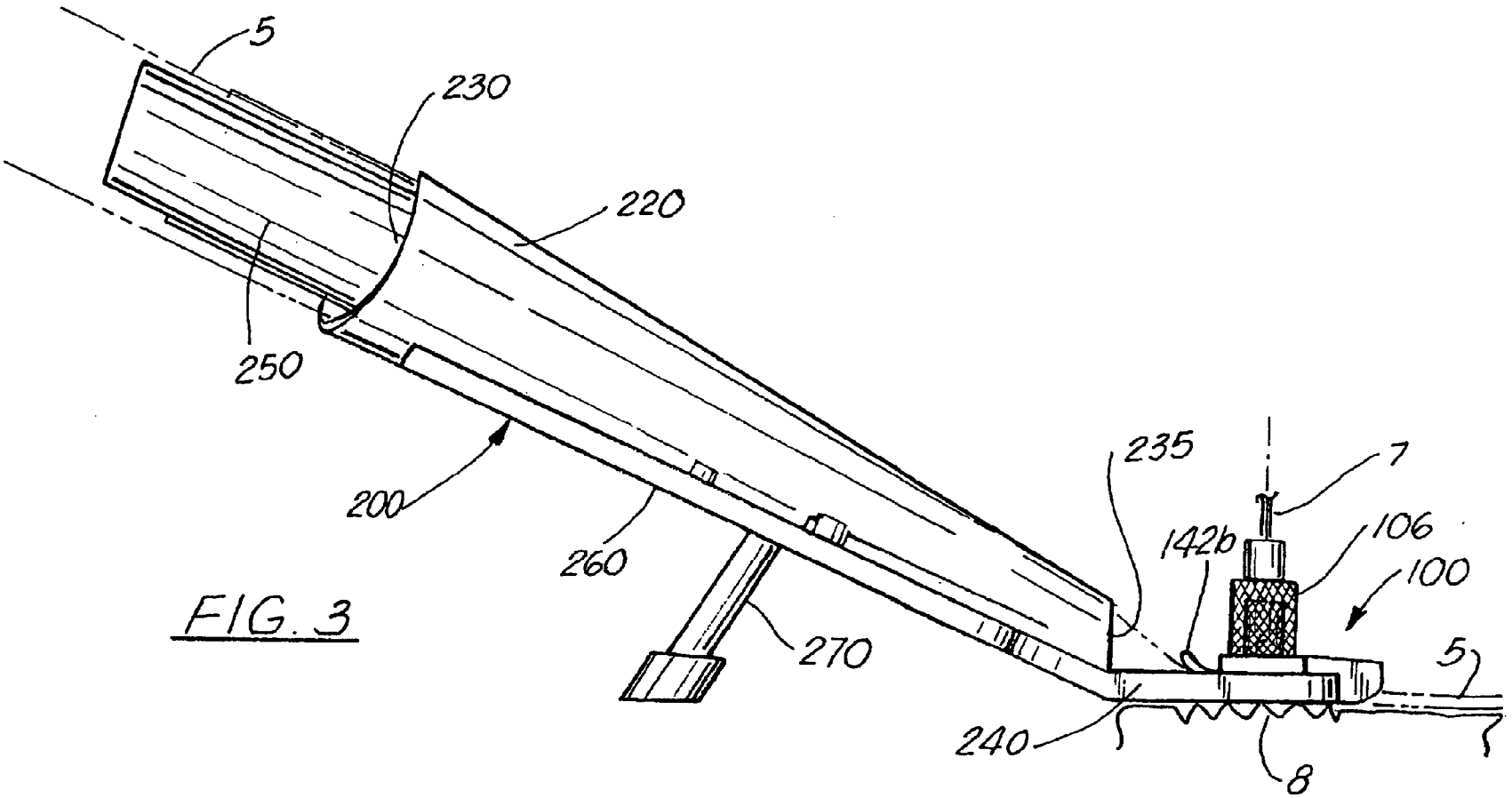
FIG. 3 illustrates a side perspective view of the pressure foot and bias binder sewing kit of the embodiment of FIG. 2 in use.

Referring now to FIGS. 2 and 3, the operation of the pressure foot 100 in combination with the bias binder sewing aid 200 will now be described. The bias binder sewing aid 200 receives biasing fabric 5 or the like having a predetermined width and automatically folds such fabric 5 wherein the center of the width remains the center of such folded biasing fabric 5. As the biasing fabric 5 is folded in the bias binder sewing aid 200, a portion of biasing fabric 5 to the left of the fabrics center is substantially folded in half and the portion of biasing fabric 5 to the right of the fabrics center is substantially folded in half. The folded sides of the biasing fabric defines a "U"-shaped fabric contour fed through the outlet port 235 in a manner so as to receive therein an unfinished edge of a cloth item, garment, quilt 2 or the like. Thus, the bias binder sewing aid 200 folds the biasing fabric 5 substantially into quarters wherein each half of the biasing fabric 5 is divided in half.

The bias binder sewing aid 200 is generally comprised of fabric folding conduit 220, inlet port 230, outlet port 235, manual feeding channel 215, machine attaching means 240, fabric feeding saddle 250 and support plate 260. However, the machine attaching means 240 of the bias binder sewing aid 200 is angled with respect to the support plate 260 approximately 135degrees and supported by legs 270. At the outlet port 235 of the binder sewing aid 200, the bias guide 120 of pressure foot 100 is aligned with such outlet port 235 to receive the folded biasing fabric 5.

More specifically, the interior wall of the inner foot 116*b* should be aligned with the folded center of the folded biasing fabric 5 as it exists the outlet port 235. Moreover, the width W of the inlet end of the channel 125 of bias guide 120 should be at least the width of the folded biasing fabric 5. The width W of the channel 125 should closely approximate the width of the folded biasing fabric 5 but the fabric should be easily feed through channel 125 without bunching.

The machine attaching means 240 has formed therein a slide channel 242 for attachment of the attachment arm 105 via fasteners 106. The fasteners 106 can be loosened to allow the attachment arm 105 to be adjusted along the length of the slide channel 242 and thereby align the inlet end of the channel 125 with outlet port 235. As can be appreciated, tightening fasteners 106 secures or locks the pressure foot 100 in position.

When aligning the channel 125 and thus the pressure foot 100, the outer foot 116*a* is generally positioned over a feed dog 8. The inner foot 116*b* is repositioned laterally to the right to no longer be in engagement with the other (inner) feed dog.

After the pressure foot 100 is aligned in the manner as described above and the binder sewing aid 200 attached to the machine, the biasing fabric 5 can be fed and folded through the binder sewing aid 200. The folded biasing fabric 5 is mated to the unfinished edge of the cloth item 2 as it exits the outlet port 235. The layered biasing fabric 5 and cloth item 2 are then fed through the channel 125 of pressure foot 100 and sewn to garment or quilt 2.

In view of the above, the pressure foot 100 can be used alone or in combination with the binder sewing aid 200 both of which are removably attached to a conventional sewing machine.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. A pressure foot for use with a conventional sewing machine comprising:

a base adapted to be mounted to a mount of the sewing machine;

parallel inner and outer feet, the outer foot being substantially aligned with an outer feed dog of the machine and an inner foot laterally displaced from the outer foot and the inner feed dog of said machine;

a bias guide formed between the inner and outer feet having a channel formed between interior walls of the outer foot and the inner foot and a joining top surface joining the inner and outer feet for feeding therethrough biasing fabric when sewing, said bias guide having a flared outlet; and, a needle and thread slot formed in the joining top surface and being generally "7" shaped and, wherein the joining top surface applies pressure to the biasing fabric underneath.

2. The pressure foot of claim 1, wherein said outer foot is a ski-shaped foot.

3. The pressure foot of claim 2, wherein the inner foot is a ski-shaped foot.

4. The pressure foot of claim 1, further comprising:

an attachment arm;

fasteners for adjustably attaching the pressure foot to a bias binder sewing aid; and a mounting pin coupled to the base for coupled to said sewing machine.

5. The pressure foot of claim 1, wherein a rear end of the interior walls of the outer foot and the inner foot gradually turn outward to form the flared outlet.

6. The pressure foot of claim 5, wherein:

the outwardly turned rear end of the outer foot turns on a straight line and a bottom surface of the rear end is beveled;

the outwardly turned rear end of the inner foot turns on a curve.

7. The pressure foot of claim 1, wherein the bias guide limits lateral movement of the biasing fabric in the direction of said inner foot and provides a seam width measurement tool.

8. A bias binding sewing aid kit for use with a conventional sewing machine comprising:

means for automatically folding biasing fabric into quarters and outputting the folded biasing fabric; and, a pressure foot having parallel inner and outer feet, the outer foot being substantially aligned with an outer feed dog of the machine and an inner foot laterally displaced from the outer foot and the inner feed dog of said machine and a bias guide formed between the inner and outer feet having a channel formed between interior walls of the outer foot and the inner foot and a joining top surface joining the inner and outer feet, said bias guide having a flared outlet; and, a needle and thread slot formed in the joining top surface and being generally "7" shaped and, wherein the joining top surface applies downward pressure to the biasing fabric underneath.

9. The kit of claim 8, wherein said outer foot is a ski-shaped foot.

10. The kit of claim 9, wherein the inner foot is a ski-shaped foot.

11. The kit of claim 8, further comprising:

an attachment arm; and, fasteners for adjustably attaching the pressure foot to the bias binder sewing aid.

12. The kit of claim 8, wherein a rear end of the interior walls of the outer foot and the inner foot gradually turn outward to form the flared outlet.

13. The kit of claim 12, wherein:

the outwardly turned rear end of the outer foot turns on a straight line and a bottom surface of the rear end is beveled;

the outwardly turned rear end of the inner foot turns on a curve.

14. The kit of claim 8, wherein the bias guide limits lateral movement of the biasing fabric in the direction of said inner foot and provides a seam width measurement tool.

* * * * *